United States Patent [19]

McCormick

[11] 4,272,870

[45] Jun. 16, 1981

[54] SYNTHETIC PLASTICS TIE MEMBER

[75] Inventor: Mathew McCormick, Manchester, England

[73] Assignee: Bowthorpe-Hellermann Limited, Crawley, England

[21] Appl. No.: 87,211

[22] Filed: Oct. 22, 1979

[30] Foreign Application Priority Data

Nov. 27, 1978 [GB] United Kingdom ..... 46108/78
Feb. 12, 1979 [GB] United Kingdom ..... 04810/79

[51] Int. Cl.[3] ..... F16L 3/08
[52] U.S. Cl. ..... 24/16 PB; 248/74 PB
[58] Field of Search ..... 248/74 PB, 74 B, 73; 24/16 PB, 81 CC, 73 PB, 17 AP, 30.5 P, 206 A, 73 PF

[56] References Cited

U.S. PATENT DOCUMENTS

| | | | |
|---|---|---|---|
| 3,302,913 | 2/1967 | Collyer et al. | 248/74 PB X |
| 3,525,128 | 8/1970 | Hidassy | 24/73 PB |
| 3,542,321 | 11/1970 | Kahabka | 248/74 PB X |
| 3,550,219 | 12/1970 | Buren | 24/73 PB |
| 3,660,869 | 5/1972 | Caveney | 24/16 PB |
| 3,819,139 | 6/1974 | Jemison | 24/73 PB X |

FOREIGN PATENT DOCUMENTS

| | | | |
|---|---|---|---|
| 954276 | 9/1974 | Canada | 24/16 PB |
| 2717622 | 10/1978 | Fed. Rep. of Germany | 24/16 PB |
| 1005269 | 9/1965 | United Kingdom | 24/16 PB |
| 1291172 | 10/1972 | United Kingdom . | |

*Primary Examiner*—J. Franklin Foss
*Attorney, Agent, or Firm*—Laubscher & Laubscher

[57] ABSTRACT

A one-piece tie of synthetic plastic material is disclosed having a flat head through which the strap passes, after looping around a bundle of cables for example, for its serrations to interlock with the teeth of a pawl which is pivoted at one end. The strap is introduced through the head from the pivoted end of the pawl, and increasing back-tension in the strap, after the tie is tied, causes the strap to pivot the pawl so as more firmly to grip the strap.

7 Claims, 9 Drawing Figures

SYNTHETIC PLASTICS TIE MEMBER

This invention relates to a one-piece tie of synthetic plastic material.

The tie which is the subject of British Pat. No. 943,240 to Emery and Insuloid was the fore-runner of synthetic plastic material one-piece ties comprising a flexible strap having ratchet serrations on one surface for locking with transverse teeth formed on a pivoted pawl when a free end of the strap is passed through an apertured head which is at the other end of the strap and which contains the pawl, wherein any tension applied to the strap tending to withdraw it again from the aperture acts to pivot the pawl so as to more firmly grip the strap against an abutment surface opposite the pawl. The aperture through the head extends generally transverse to the plane of the strap. Such ties have hitherto been used with widespread success in tying around bundles of electric cables or the like.

The heads of the above ties are not flat and this is a disadvantage in certain applications. For example, one proposed application of one-piece cable tie is an orthopedic application, but the head of the known ties do not lie sufficiently flat against the bone surface, and indeed protrudes considerably even when the excess length of the strap projecting beyond the head is cut off, so that a noticeable protuberance will occur on the surface face of the limb, for example, even after the wound has healed.

SUMMARY OF THE INVENTION

In accordance with the invention, there is provided a one-piece tie of synthetic plastic material, comprising a flexible elongate strap formed on a first side thereof with a series of ratchet serrations, a head at one end of the strap and projecting from one side of the strap, an aperture extending through the head generally parallel to the plane of the strap, and a pawl disposed to form a side of the aperture and being provided with a plurality of teeth, the pawl being pivotably mounted at one of its ends for movement of all its teeth in respective arcs across the aperture, the aperture being formed generally opposite the pawl with an abutment surface or surfaces, the ratchet serrations and pawl teeth being profiled so as to co-operate and permit passage of the free end of the strap through the aperture from the pivoted end of the pawl when the strap is tied with said one side facing outwards but so as to prevent subsequent withdrawal of the strap in the opposite direction, any tension applied to the strap in the opposite direction serving to pivot the pawl to firmly grip the strap against the abutment surface or surfaces.

Accordingly, when the tie is tied, the length of strap projecting from the head lies flat against the underlying portion of strap which extends from the head. The invention enables a much flatter head than the prior art cable ties.

The locking teeth of the head are provided on a pivoting pawl, instead of being formed immovably on a solid portion of the head as in some alternative types of tie. Two advantages therefore derive. Firstly, the strap can be inserted through the head reasonably easily, because the pawl pivots so as to open the aperture, by a camming action between the strap serrations and pawl teeth. Secondly, a greater locking strength is achieved against withdrawal of the strap, because increased tension applied to the strap in the withdrawal direction serves only to pivot the pawl so as to more firmly grip the strap against the abutment surface or surfaces of the head.

BRIEF DESCRIPTION OF THE FIGURES

Embodiments of the invention will now be described, by way of examples only, with reference to the accompanying drawings, in which.

DETAILED DESCRIPTION

Figure 1:
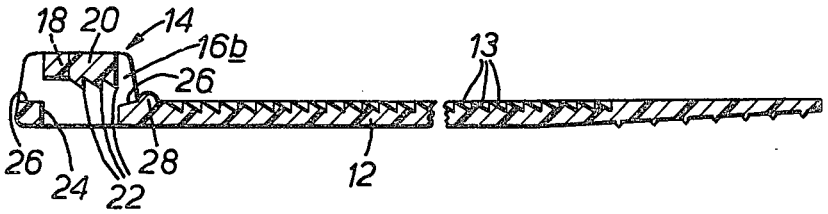
FIG. 1 is a longitudinal section through a one-piece tie in its as-moulded condition.
Figure 2:
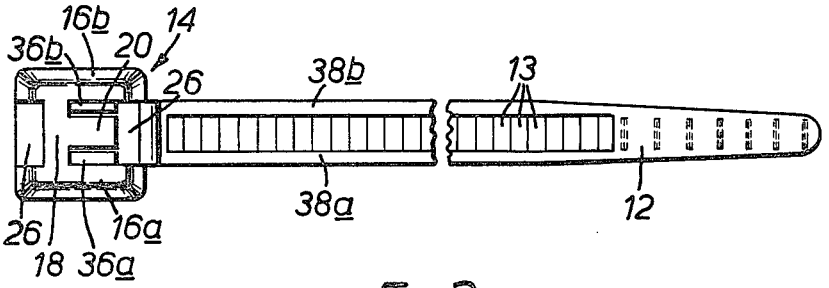
FIG. 2 is a plan view of the tie.
Figure 3:
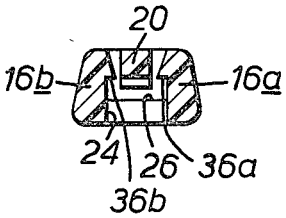
FIG. 3 is a cross-section through the head of the tie.

Referring to FIGS. 1 to 3 of the drawing, there is shown a one-piece tie of synthetic plastic material comprising a flexible elongate strap 12 provided with a series of transverse ratchet serrations 13 on one side thereof and a generally rectangular head 14 at one end thereof, the head projecting from the serrated side of the strap. The head 14 comprises a pair of parallel side walls **16*a*, 16*b* projecting from the serrated side of the strap, and a cross-piece 18 by which a pawl 20 is pivotably mounted between the opposite side walls of the head. Thus the pawl 20 has one end united to the cross-piece 18 and extends generally parallel to the plane of the strap towards the other, free end of the strap, and spaced away from the serrated side of the strap. The pawl is provided with a series of three transverse teeth 22**.

The base of the head, being the extreme end portion of the strap itself, is formed with a rectangular aperture or opening 24 directly aligned, lengthwise of the strap, with the pawl and its cross-piece 18, as shown in FIG. 1. The aperture 14 extends the full width of the strap, being the spacing between the walls **16*a*,16*b***.

It will be noted that the head is effectively formed with a through-aperture 25, extending generally parallel to the plane of the strap in the as-molded condition, and disposed between the base of the head and the pawl and the cross-piece 18. The width of the head aperture is slightly greater than the width of the strap: the depth of the head aperture, between the under-side of the cross-piece 18 and the upper surface of the base of the head, is slightly greater than the overall thickness of the strap. The upper surface of the base of the head is divided, by the aperture 24, into two portions 26 which serve as strap abutment surfaces when the tie is tied.

The ratchet serrations 13 of the strap and the teeth 22 of the pawl are complementarily profiled as shown so as to interengage when the strap is tied around a bone with the serrated side of the strap facing radially outwards, and the free end of the strap is pulled through the aperture in the head from left to right as viewed in FIGS. 1 and 2. The head 14 is provided with a pair of guiding abutment surfaces **36*a*,36*b* on the side walls 16*a*,16*b*, generally parallel to the head aperture, for marginal plain portions 38a,38b of the strap to run upon when the strap is being pulled through the head. The length of the strap serrations across the strap is greater than the width of the pawl but less than the transverse distance between the two guiding abutment surfaces. In the example, the plain marginal portions 38a,38b are flush with the crests of the strap serrations and the guiding abutment surfaces are spaced from the strap abutment surfaces 26** by slightly greater than the overall thickness of the strap.

In use of the tie, the strap is looped around the bone to which it is to be applied, with the serrated side of the strap facing radially outwards. The free end of the strap is passed through the head aperture and then tension is applied to the free end of the strap, projecting from the right hand side of the head as viewed in FIG. 1, to pull the strap through the head aperture and tight around the bone. As the strap is pulled through the head aperture, the successive strap serrations ride over the pawl teeth, causing the pawl to repeatedly pivot away from the strap (thus opening the head aperture wider) by the inclined surfaces of the serrations sliding on the inclined surfaces of the pawl teeth, to accommodate the linear movement of the head. In this connection it will be noted that the strap serrations and pawl teeth are profiled so as to permit insertion of the strap through the head from left to right, as viewed in FIG. 1, but so as to prevent withdrawal in the opposite direction.

When the tensioning force is removed from the free end of the strap, the back-tension within the looped portion thereof causes the strap to tend to move relative to the head, in the withdrawal direction. The serrations 13 accordingly lock with the pawl teeth and the back tension serves to pivot the pawl so as to grip the strap flat against the strap abutment surfaces 26. Increasing back tension serves to increase this pivoting of the pawl and more firmly grip the strap against the strap abutment surfaces 26.

It will be noted that the crests of the pawl teeth lie in a common plane parallel to the head aperture. Each pawl tooth comprises a first, inclined surface as shown, but its second surface is not perpendicular to the head aperture, but is slightly inclined as shown. The strap serrations are similarly oriented. As a result, the force to which each pawl tooth is subjected, by its mating strap serrations (which force is normal to said second surface of the pawl tooth) is inclined to the common plane of the pawl teeth crests, in a direction (upwards and leftwards as viewed in FIG. 1) generally towards the pivoting axis (which is contained within cross-piece 18). Because the force on the pawl teeth is inclined towards the pivoting axis in this manner, rather than parallel to the head aperture, the risk is reduced of the pawl being sheared from the head under conditions of excessive back-tension in the strap.

The tie is manufactured by injection molding from synthetic plastic material such as nylon, using two dies defining a mold cavity and separable in a straight line perpendicular to the plane of the strap. The aperture 24 facilitates molding of the pawl teeth by an upwards projecting part carried by the lower of upper and lower dies. The aperture 24 also serves to receive a stainless steel pad, provided with barbs which bite into and maintain a purchase on the bone during tying. This pad thereafter enables X-ray identification.

The particularly flat-head design of the tie will be noted. Apart from orthopedic applications, the tie may be used in other applications, for example, tying bundles of electric cables or the like.

It will be noted that the abutment surface 26 at the outlet end of the head aperture is inclined upwardly, as viewed in FIG. 1, and is followed by a raised, transverse rib 28 of semi-circular section. These two features ensure that the free end of the strap, projecting from the head after the tie is tied, will project from the head in an inclined direction away from the underlying portion of the strap: thus the free, projecting end of the strap can be more easily grasped for pulling through the head to tension the tie.

Figures 4, 5, 6, 7, 8, 9:
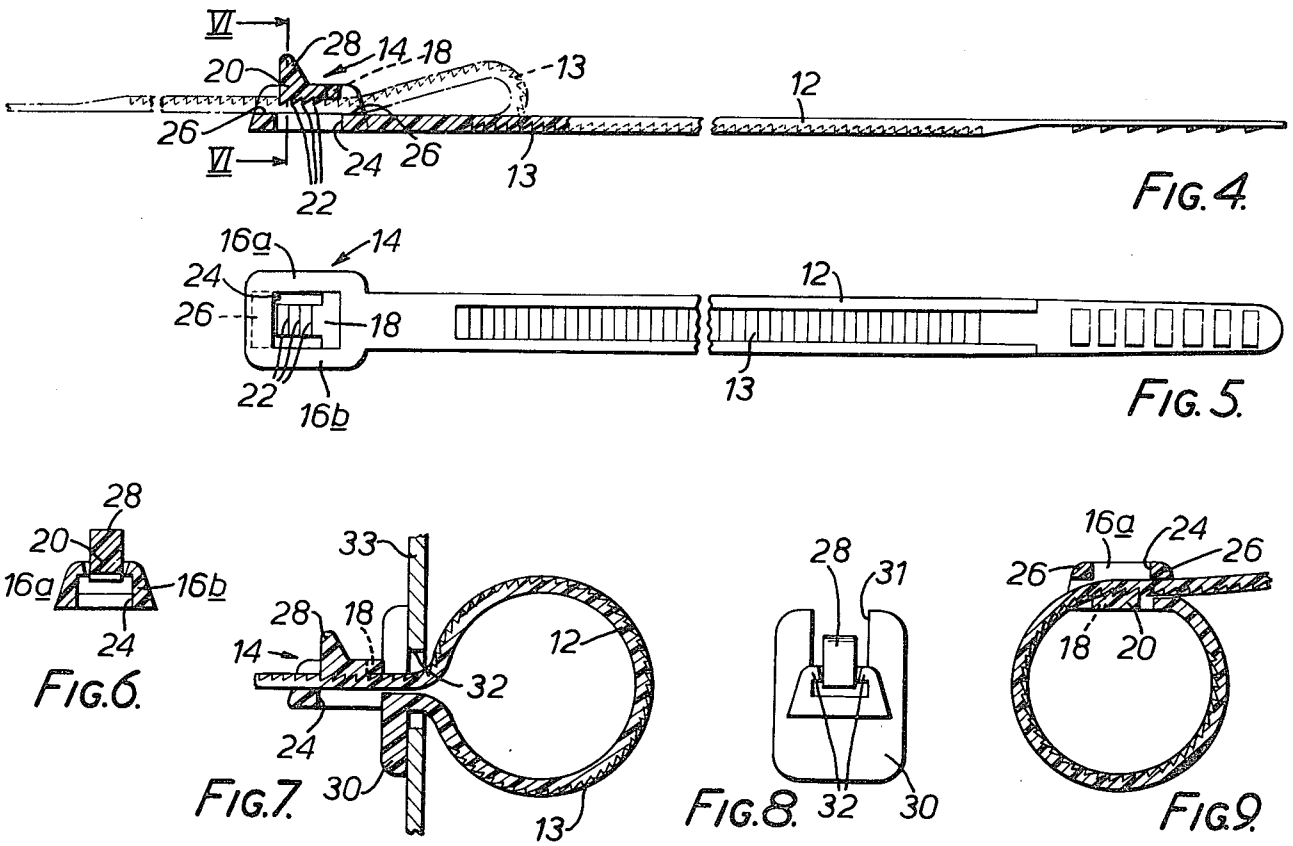
FIG. 4 is a medial longitudinal section of a second embodiment of tie, indicating both its as-molded form and its mode of tying.
FIG. 5 is a plan view of the tie of FIG. 4.
FIG. 6 is a cross-section on the line VI—VI of FIG. 4.
FIG. 7 is a medial longitudinal section of a tie modified from the tie of FIGS. 4–6, shown in tied condition.
FIG. 8 is a view in the direction of arrow E shown in FIG. 7.
FIG. 9 is a medial section of a third embodiment of tie, shown in tied condition.

Referring to FIGS. 4–6 of the drawings, there is shown a one-piece tie of synthetic plastic material comprising a flexible elongate strap 12 provided with a series of transverse ratchet serrations 13 on one side thereof and a generally rectangular head 14 at one end thereof, the head projecting from that side of the strap which is opposite the serrated side of the strap. The head 14 comprises a pair of parallel side walls 16a,16b projecting from the non-serrated side of the strap, and a cross-piece 18 by which a pawl 20 is pivotably mounted between the opposite side walls of the head. Thus, the pawl 20 has one end united to the cross-piece 18 and extends generally parallel to the plane of the strap towards said one end of the strap (away from the other, free end thereof), and spaced from the serrated side of the strap. The pawl is provided with a series of four transverse teeth 22.

It will be noted that the head is effectively formed with a through-aperture, extending generally parallel to the plane of the strap in the as-molded planar condition, and disposed between the base of the head (which is apertured at 24) and the cross-piece 18 and pawl 20. The upper surface of the base of the head is divided, by the aperture 24, into two portions 26 which serve as strap abutment surfaces when the tie is tied.

The ratchet serrations 13 of the strap and the teeth 22 of the pawl are complementarily profiled as shown so as to interengage when the strap is tied around a bundle of cables, for example, with the serrated side of the strap facing outwards, as indicated in FIG. 4, and the free end of the strap is pulled through the head from right to left as viewed in FIG. 4.

Thus, in use of the tie, the strap is looped around the bundle of cables or the like, for example, with the serrated side facing radially outwards. The free end of the strap is passed through the head aperture and then tension is applied to the free end of the strap, projecting from the left side of the head as viewed in FIG. 4, to pull the strap through the head aperture and tight around the bundle of cables. As the strap is pulled through the head aperture, the successive strap serrations ride over the pawl teeth, causing the pawl to repeatedly pivot away from the strap (thus opening the head aperture wider) by the inclined surface of the serrations sliding on the inclined surfaces of the pawl teeth, to accommodate the linear movement of the strap through the head. In particular, all pawl teeth are spaced from the pawl pivot in the direction of the head aperture so as to all move in respective arcs transverse of the aperture.

When the tensioning force is removed from the free end of the strap, the back-tension within the looped portion thereof causes the strap to tend to move relative to the head, in the withdrawal direction. The serrations 13 accordingly lock with the pawl teeth and the back tension serves to pivot the pawl so as to grip the strap flat against the strap abutment surfaces 26. Increasing back tension serves to increase this pivoting of the pawl and more firmly grip the strap against the strap abutment surfaces.

A projecting lug 28 is provided on the pawl and enables the pawl to be manually pivoted (clockwise as viewed in FIG. 4) to release the strap. The tie is thus releasable and re-usable. Such a lug may be provided also in the tie of FIGS. 1 to 3.

The tie is manufactured by injection molding from synthetic plastic material such as nylon, using two dies defining a mold cavity and separable in a straight line perpendicular to the plane of the strap.

It will be appreciated that when the tie of FIGS. 4–6 is tied, the head projects more or less in the radial direction relative to the bundle of cables or the like which it ties. This makes it particularly useful for securing the bundle of cables to a panel and a particular modification for this application is shown in FIGS. 7 and 8. Thus, the modification consists in the provision of a rectangular collar 30 molded integrally with the head, at the end of the head to which the pawl is pivoted, and extending in a plane perpendicular to that of the head. The collar 30 is slotted at 31 to accommodate pivoting movement of the pawl. In use, the free end of the strap is passed through an aperture 32 in the panel 33 from the rear side of the panel and is then looped around the bundle of cables to be passed through the head aperture and tensioned in the same manner as described in relation to the tie of FIGS. 4–6. The collar 30 becomes pressed flat against the rear side of the panel and the cable bundle is tied by the strap and secured against the front side of the panel.

In the third embodiment shown in FIG. 9, the pawl 20 lies generally planar with the strap, in the as-molded, flat, condition of the tie and the abutment surfaces 26 are formed by a bridging portion between the two parallel sides **16*a*, 16*b* of the head, which bridging portion is parallel to but spaced from the plane of the strap and is provided with the aperture 24. The two parallel sides 16*a*, 16*b* form continuations of the one of the strap and the pawl 20 extends inwards from the cross-piece 18 which is situated adjacent the outer end of the head. When tied, the strap serrations face against the bundle being tied but the head lies flat against the bundle, in the same manner as the tie of FIGS. 1 to 3**.

Particularly in FIG. 8, guide ribs 34 will be seen from the marginal plane edge portions of the strap to run upon when the strap is being pulled through the head.

I claim:

1. A unitary tie molded of synthetic plastic material, comprising a flexible elongated planar strap member (12) including (a) a body portion one surface of which contains a plurality of serrations (13) extending longitudinally between a pair of plain portions (**38*a*, 38*b*); and (b) a head portion (14) connected with one end of said body portion, said head portion extending laterally of the strap member and including, (1) a pair of side walls (16*a*, 16*b***) adjacent opposite longitudinal edges of said strap member, respectively;

(2) a cross-piece (18) extending transversely between said side walls;

(3) a pawl (20) pivotally connected at one end with said cross-piece, the other end of said pawl extending longitudinally of said strap member; and (4) an abutment wall (26) extending transversely between said side walls generally opposite and spaced from said cross-piece and said pawl, said side walls, said cross-piece, said pawl, and said abutment wall being arranged to define an aperture (25) extending longitudinally through said head portion;

(5) said pawl including a plurality of teeth (22) opposite said abutment wall and having a configuration complementary to said serrations, each of said teeth defining an arcuate path, respectively, through said aperture during pivotal movement of said pawl;

(6) said side walls including longitudinal guide abutment surfaces (**36*a*, 36*b***) adjacent said pawl opposite and spaced from said abutment wall, respectively, the distance between said abutment wall and said guide surfaces corresponding generally with the thickness of said body portion, whereby when the other end of said body portion is initially inserted within said aperture at the end thereof adjacent the pivotal end of said pawl, the body is guided during further longitudinal insertion through the aperture by the cooperation between said guide abutment surfaces and said marginal plane portions, respectively;

(7) the teeth on said pawl and the serrations on said body portion being operable upon subsequent displacement of said body portion in the opposite direction relative to the aperture to cause said pawl to pivot in the direction of said abutment wall to lock said body portion thereagainst.

2. A tie as defined in claim 1, wherein said head portion extends laterally from said body portion one surface, said pawl and said cross-piece being spaced from said one surface, and further wherein the pivotally connected end of said pawl is arranged nearer said strap member one end.

3. A tie as defined in claim 1, wherein said head portion extends laterally from said body portion opposite said one surface, said pawl and said cross-piece being arranged co-planar with said one surface, and further wherein the pivotally connected end of said pawl is arranged nearer said strap member one end.

4. A tie as defined in claim 8, wherein said head portion extends laterally from said body portion opposite said one surface, said pawl and said cross-piece being spaced from said one surface, and further wherein the pivotally connected end of said pawl is arranged nearer said strap member other end.

5. A tie as defined in claim 4, wherein said head portion further includes a collar (30) arranged between said pawl and said body portion for abutting a support panel when the other end of said body portion is passed through an opening in the panel.

6. A tie as defined in claims 2, 4, or 5, wherein said pawl includes a projecting lug portion (28), whereby said pawl may be manually pivoted away from said serrations to release said teeth from said head portion.

7. A tie member as defined in claim 1, wherein said head portion contains an opening (24) opposite said pawl teeth, whereby said tie is molded in a two-part mold separable perpendicular to the plane containing said strap member.

* * * * *